US008025583B2

(12) United States Patent
Cartwright

(10) Patent No.: US 8,025,583 B2
(45) Date of Patent: Sep. 27, 2011

(54) BILLIARD TABLE AND RAIL CLOTH COVERING SYSTEM

(76) Inventor: Thomas Cartwright, Stuart, FL (US)

( * ) Notice: Subject to any disclaimer, the term of this patent is extended or adjusted under 35 U.S.C. 154(b) by 103 days.

(21) Appl. No.: 11/747,455

(22) Filed: May 11, 2007

(65) Prior Publication Data

US 2007/0275785 A1 Nov. 29, 2007

Related U.S. Application Data

(60) Provisional application No. 60/800,223, filed on May 12, 2006, provisional application No. 60/882,688, filed on Dec. 29, 2006.

(51) Int. Cl.
*A63D 15/06* (2006.01)
*A63D 15/00* (2006.01)

(52) U.S. Cl. ..... 473/30; 473/31

(58) Field of Classification Search ..... 473/30, 473/29, 33, 32, 1, 496; 273/309; 108/90
See application file for complete search history.

(56) References Cited

U.S. PATENT DOCUMENTS

| | | | |
|---|---|---|---|
| 14,290 | A | 2/1856 | Phelan |
| 18,841 | A | 12/1857 | Decker |
| 20,156 | A | 5/1858 | Holman |
| 21,159 | A | 8/1858 | Winant |
| 22,001 | A | 11/1858 | Winant |
| 22,020 | A | 11/1858 | Decker |
| 22,263 | A | 12/1858 | Came |
| 23,340 | A | 3/1859 | Bassford |
| 23,341 | A | 3/1859 | Bassford |
| 35,851 | A | 7/1862 | Wacker |
| 40,580 | A | 11/1863 | Syrcher |
| 61,308 | A | 1/1867 | Bassford |
| RE2,510 | E | 3/1867 | Collender |
| RE2,512 | E | 3/1867 | Collender |
| RE3,323 | E | 3/1869 | Decker |
| 99,393 | A | 2/1870 | Berlien |
| 101,163 | A | 3/1870 | Richards |
| 104,542 | A | 6/1870 | Berlien |
| 114,410 | A | 5/1871 | Collender |
| 118,288 | A | 8/1871 | Smith |
| 119,391 | A | 9/1871 | Murphy |
| 123,722 | A | 2/1872 | Natus |
| 128,985 | A | 7/1872 | Stroup |
| 131,890 | A | 10/1872 | Meyer |
| 359,031 | A | 3/1873 | Phelan |
| 139,434 | A | 5/1873 | St. Martin |
| 140,162 | A | 6/1873 | Prindle |
| 142,435 | A | 9/1873 | Carne |
| 143,961 | A | 10/1873 | Brunswick et al. |

(Continued)

FOREIGN PATENT DOCUMENTS

WO WO 01/89347 A1 11/2001

*Primary Examiner* — Mitra Aryanpour
(74) *Attorney, Agent, or Firm* — The Concept Law Group, P.A.; Scott D. Smiley

(57) ABSTRACT

A hook and loop fastening system for attaching a billiard table cloth to a table bed and a rail, a billiard table cloth with template markings for assisting the installer in the correct positing and tensioning of the bed cloth and in the cutting of slits in the cloth for pocket openings (for pocket pool tables) and rail bolt holes, and a rail cloth that incorporates a tract system for attaching the rail cloth on rails to replace conventional feather strips.

6 Claims, 10 Drawing Sheets

U.S. PATENT DOCUMENTS

| | | | | | |
|---|---|---|---|---|---|
| 155,570 | A | | 10/1874 | Collins et al. | |
| 167,501 | A | | 9/1875 | Collender | |
| 193,751 | A | | 7/1877 | Collender | |
| RE8,172 | E | | 4/1878 | Boyle | |
| 233,531 | A | | 10/1880 | May | |
| 238,414 | A | | 3/1881 | May | |
| 240,541 | A | | 11/1881 | Morse | |
| 257,541 | A | | 5/1882 | Babcock | |
| 275,592 | A | | 4/1883 | Collender | |
| 275,593 | A | | 4/1883 | Collender | |
| RE10,322 | E | | 5/1883 | De Gaetano | |
| 283,129 | A | | 8/1883 | May | |
| 295,910 | A | | 4/1884 | Delaney | |
| 305,463 | A | | 9/1884 | Morse | |
| 317,017 | A | | 5/1885 | Rivoire | |
| RE10,647 | E | | 9/1885 | Collender | |
| 136,178 | A | | 2/1887 | Phelan | |
| 383,005 | A | | 5/1888 | O'Connor | |
| 400,044 | A | | 3/1889 | Brockway | |
| 459,957 | A | | 9/1891 | Buttery | |
| 468,076 | A | | 2/1892 | Briggs | |
| 481,094 | A | | 8/1892 | Bensinger | |
| 569,519 | A | | 10/1896 | Rodd | |
| 572,545 | A | | 12/1896 | Ives | |
| 576,767 | A | | 2/1897 | Stebbins | |
| 578,009 | A | | 3/1897 | De Gaetano | |
| 599,371 | A | | 2/1898 | Taft | |
| 605,872 | A | | 6/1898 | Hand | |
| RE11,799 | E | | 1/1900 | Kern | |
| 820,929 | A | | 5/1906 | Hubert-Brierre | |
| 820,930 | A | | 5/1906 | Hubert-Brierre | |
| 664,292 | A | | 8/1907 | Cohen | |
| 864,292 | A | * | 8/1907 | Cohen | 473/30 |
| 889,843 | A | * | 6/1908 | Barrett | 473/30 |
| 946,570 | A | | 1/1910 | Teeter | |
| 1,003,880 | A | | 9/1911 | Créchriou | |
| 1,036,238 | A | * | 8/1912 | Hjort | 473/30 |
| 1,119,212 | A | | 12/1914 | Abbott | |
| 1,158,793 | A | | 11/1915 | Drouot | |
| 1,161,111 | A | | 11/1915 | Campion et al. | |
| 1,169,585 | A | | 1/1916 | Whelan | |
| 1,213,950 | A | | 1/1917 | Ringsmith | |
| 1,259,694 | A | | 3/1918 | Weslow | |
| 1,323,516 | A | | 12/1919 | Arland | |
| 1,404,119 | A | | 1/1922 | Harris | |
| 1,441,060 | A | | 1/1923 | Bullock | |
| 1,443,266 | A | | 1/1923 | King | |
| 1,478,046 | A | | 12/1923 | Miller | |
| 1,516,654 | A | | 11/1924 | Treiber | |
| 1,524,758 | A | | 2/1925 | Stedman et al. | |
| 1,534,712 | A | | 4/1925 | Hoskin | |
| 1,579,730 | A | * | 4/1926 | Nelson | 473/30 |
| 1,725,215 | A | * | 8/1929 | Seal | 473/30 |
| 2,755,088 | A | * | 7/1956 | Allman | 473/30 |
| 3,295,577 | A | * | 1/1967 | Danielson | 108/90 |
| 3,330,559 | A | | 7/1967 | Fischer et al. | |
| 3,367,654 | A | | 2/1968 | Woods | |
| 3,463,488 | A | | 8/1969 | Milu | |
| 3,466,035 | A | | 9/1969 | Duarte | |
| 3,477,716 | A | | 11/1969 | Bender | |
| 3,521,847 | A | | 7/1970 | Porter | |
| 3,729,192 | A | | 4/1973 | Nielsen | |
| 3,811,673 | A | * | 5/1974 | Baker | 473/31 |
| 3,897,290 | A | | 7/1975 | Haller | |
| 4,056,266 | A | * | 11/1977 | Gramstrup | 473/31 |
| 4,063,728 | A | | 12/1977 | Zemanek | |
| 4,508,338 | A | | 4/1985 | Kremski | |
| 4,627,363 | A | * | 12/1986 | Jones | 108/90 |
| 5,084,321 | A | * | 1/1992 | Sui | 428/80 |
| 5,203,055 | A | * | 4/1993 | Broadwater, Sr. | 24/462 |
| 5,346,209 | A | | 9/1994 | Kring | |
| 5,482,268 | A | | 1/1996 | Driska | |
| 5,778,802 | A | * | 7/1998 | Hairston et al. | 108/90 |
| 5,971,861 | A | * | 10/1999 | Wright | 473/14 |
| 6,074,720 | A | | 6/2000 | Van Stratum | |
| 6,761,643 | B2 | * | 7/2004 | Boatwright | 473/2 |
| 6,945,533 | B1 | | 9/2005 | Salerno | |
| 7,223,177 | B2 | * | 5/2007 | Tarbell | 473/30 |

* cited by examiner

BILLIARD TABLE AND RAIL CLOTH COVERING SYSTEM

CROSS-REFERENCE TO RELATED APPLICATIONS

This application claims priority from U.S. Provisional Patent Application Ser. No. 60/800,223, filed May 12, 2006 and U.S. Provisional Patent Application Ser. No. 60/882,688, filed Dec. 29, 2006. The disclosures of both priority patent applications are herein incorporated by reference.

FIELD OF THE INVENTION

This invention relates to coverings for billiard tables, pocket pool tables, and other game tables, and the method for installing the same.

BACKGROUND OF THE INVENTION

Until now billiard tables and pocket pool tables have required a skilled or trained installer/mechanic to put the bed and rail cloth on the table. One of the main skills required is to pull the cloth to the correct tension on as it lies on the table and rail surface. Conventionally, this tensioning step is achieved by securing the cloth to one end or side of the table bed with staples, glue, or feather strips on rails, then pulling the cloth to the opposite end or side. The main consideration is for the amount of stretch the cloth must have to place the cloth under correct tension for the table's playing surfaces, and the amount of stretch may depend on certain factors, such as the type of cloth material. This method is repeated for the two opposite sides and all six rails.

When installing the bed and rail cloth the cloth must be cut at the pocket openings. This is necessary on pocket pool tables, to allow for entry of balls into pockets and for angles on rail ends. Then the cloth is cut into tabs or small sections that are secured to the table by means of staples or glue.

The installer/mechanic performs all of these steps using his or her best judgment as to the correct tension of the cloth on the table when stretching, and as to where the tabs in the cloth must be cut at the pocket openings and rail ends. Determining the correct cloth tension and making accurate cuts require installer expertise, and can consume considerable time.

Therefore, a covering system that aids the installer in applying the appropriate tension to the cloth, and positioning the cuts for the pocket openings and rail ends, is desirable. A method for using such a system is likewise desirable.

SUMMARY OF THE INVENTION

The invention provides a hook and loop fastening system, such as Velcro® or an adhesive system (such as peel and stick method), for attaching a billiard table cloth to a table bed and a rail. The invention further provides a billiard table cloth with template markings for assisting the installer in the correct positing and tensioning of the bed cloth and in the contouring of the cloth for pocket openings (for pocket pool tables) through various cutting and stitching (sewn) patterns. The invention still further provides a tract system for attaching the cloth on rails that replaces conventional feather strips as well as for preforming the cloth so that on-site cutting and forming is not required.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

The invention provides a system to eliminate the customary guesswork and independent judgment usually required of an installer of a new cloth covering for a billiard or pool table. An installer with only basic skill may use this new cloth covering system, which reduces sharply the labor cost of replacement of the cloth. The system of the present invention provides a new method of securing the cloth to the table using a pre-determined correct tensioning of the stretched cloth, and of preforming the pocket openings with various stitching (sewn) patterns in the cloth. Labor costs for initial installation of the cloth at the time of table production may also be reduced by use of the present invention.

In the present application, the term "game table" will be used to denote any of a billiard table, a pocket pool table, a bumper pool table, or any similar table requiring a level, smooth surface on which a ball may roll and a set of surrounding cushions that have sufficient elasticity to cause a ball rolling on the surface to bounce back away from a cushion on impact.

Structure Description

Figure 1:
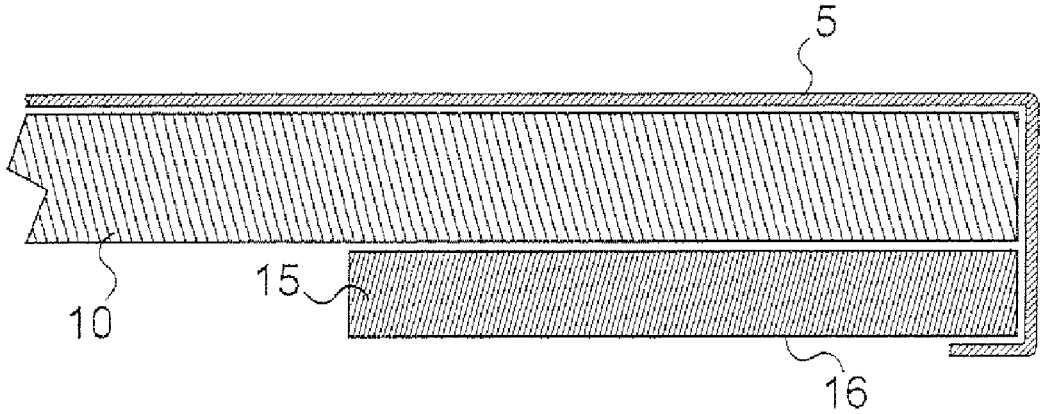
FIG. 1 (PRIOR ART)
FIG. 1 is a cross-sectional view of the game table and covering of the prior art.

FIG. 1 shows the prior-art conventional arrangement in which a bed cloth 5, which is the cloth covering the playing surface of the table slate 10 and the cushions of a game table, is attached to the underlying flat surface 16 of the table support structure 15.

Figure 2:
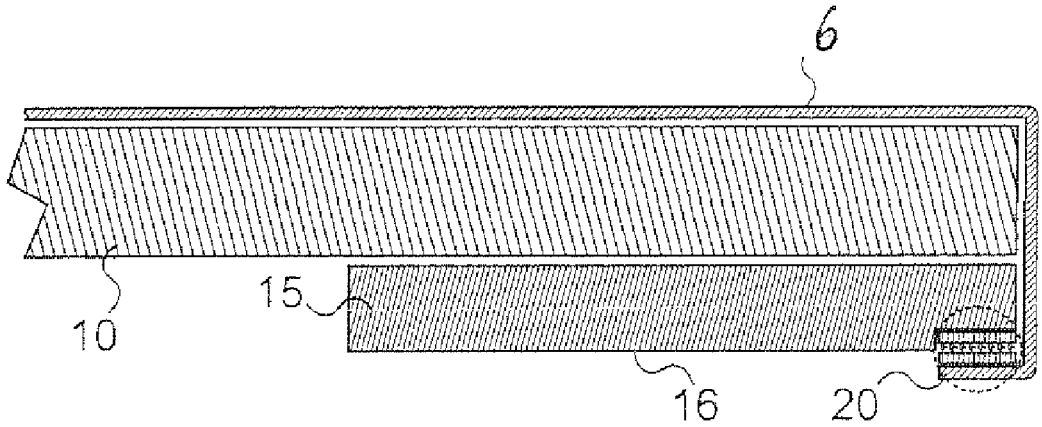
FIG. 2 is a cross-sectional view of the game table and covering of the present invention, showing the hook and loop fastening system in a first table embodiment.
Figure 2A:
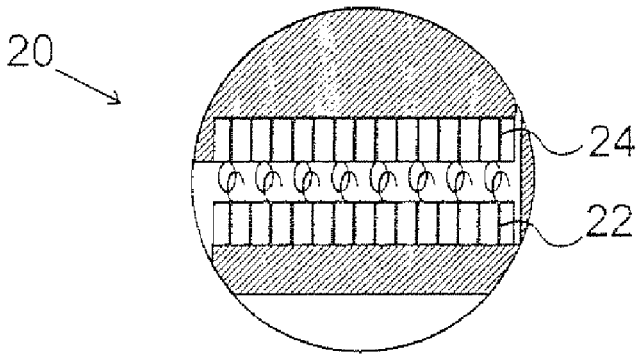
FIG. 2A is a detail view of the hook and loop fastening system of the present invention.

A first table embodiment of the present invention is shown in FIG. 2 in cross section. The cloth 6 is secured to the table support structure 15 by means of a two part ("A & B") hook and loop fastening system 20, such as a Velcro® system, shown in detail in FIG. 2A. The system has the "A" part 22 pre-attached to the cloth and the complementary "B" part 24 pre-attached to the table. This eliminates the tools and mess associated with methods that require gluing to secure the cloth to the table. A pre-attached no-mess, peel-and-stick glue or adhesive system may also be used. Also, mechanical fasteners, such as staples, may be used to further secure the bed cloth once the bed cloth is in the desired position.

Figure 3:
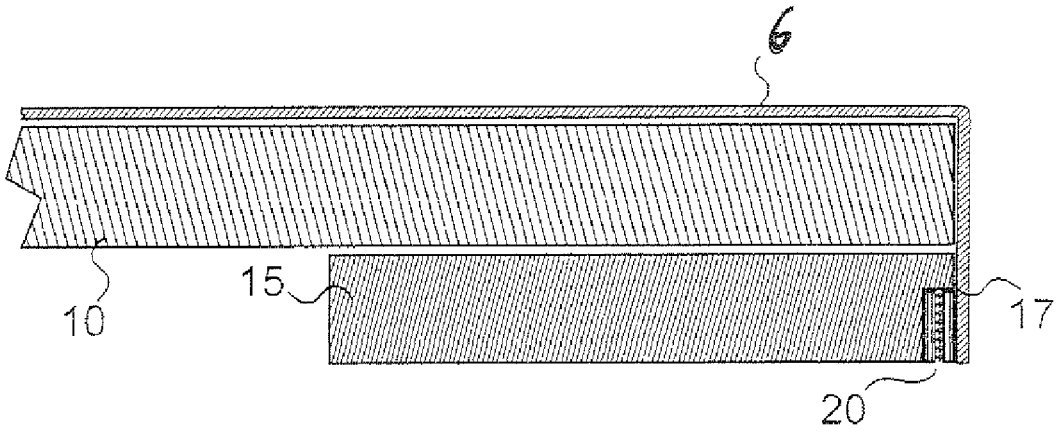
FIG. 3 is a cross-sectional view of the game table and covering of the present invention, showing the hook and loop fastening system in a second table embodiment.

In its first table embodiment in FIG. 2 the "B" part 24 of the hook and loop fastening system 20 is pre-attached to the horizontal face 16 of the table support structure 15, where it engages with the "A" part 22 of the hook and loop fastening system. In a second table embodiment, shown in FIG. 3, the "B" part 24 of the invention is pre-attached to the vertical face 17 of the table support structure 15, where it engages with the "A" part 22 of the hook and loop fastening system.

Figure 4:
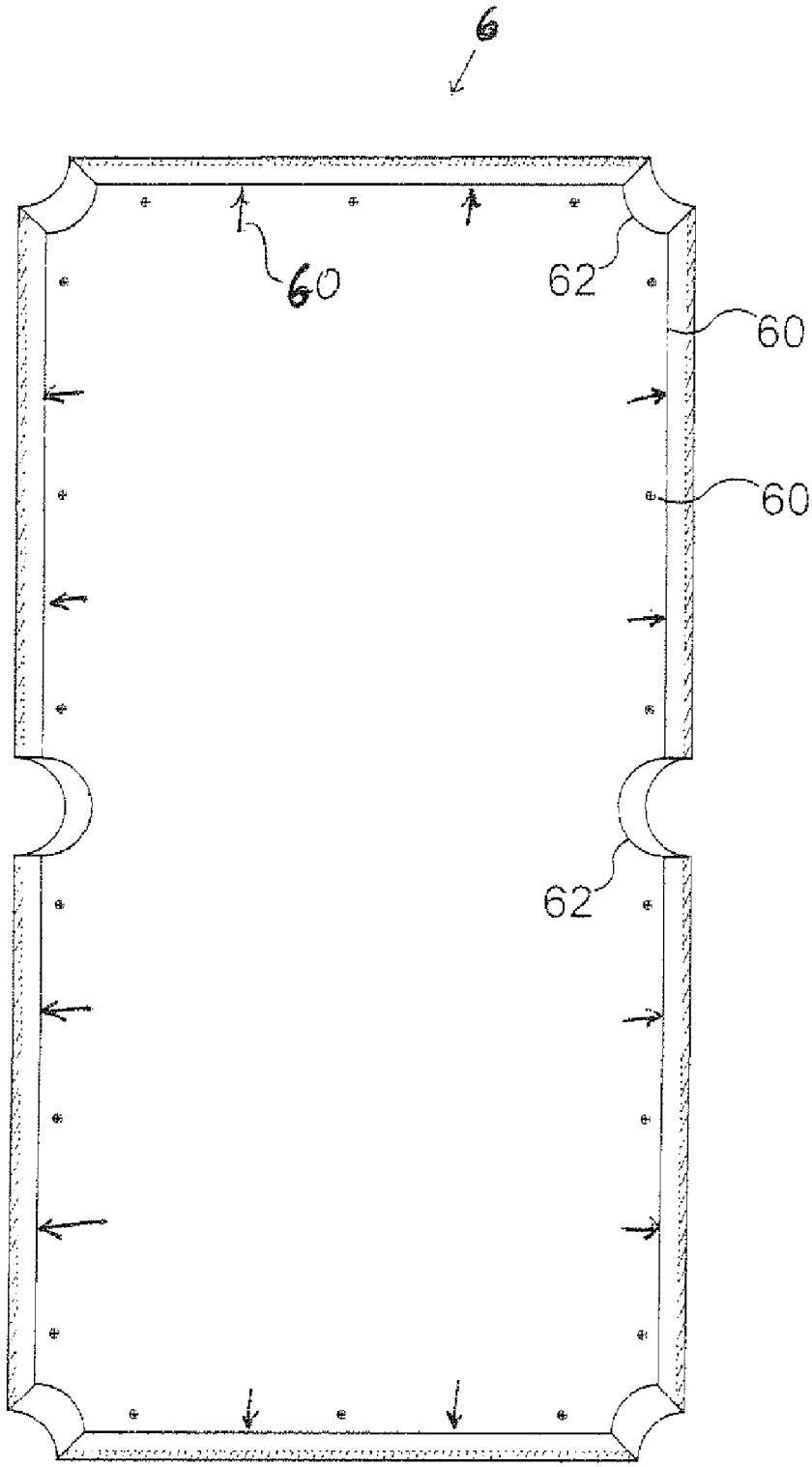
FIG. 4 is a plan view of the top of the game table covering cloth with template markings according to the present invention.
Figure 5:
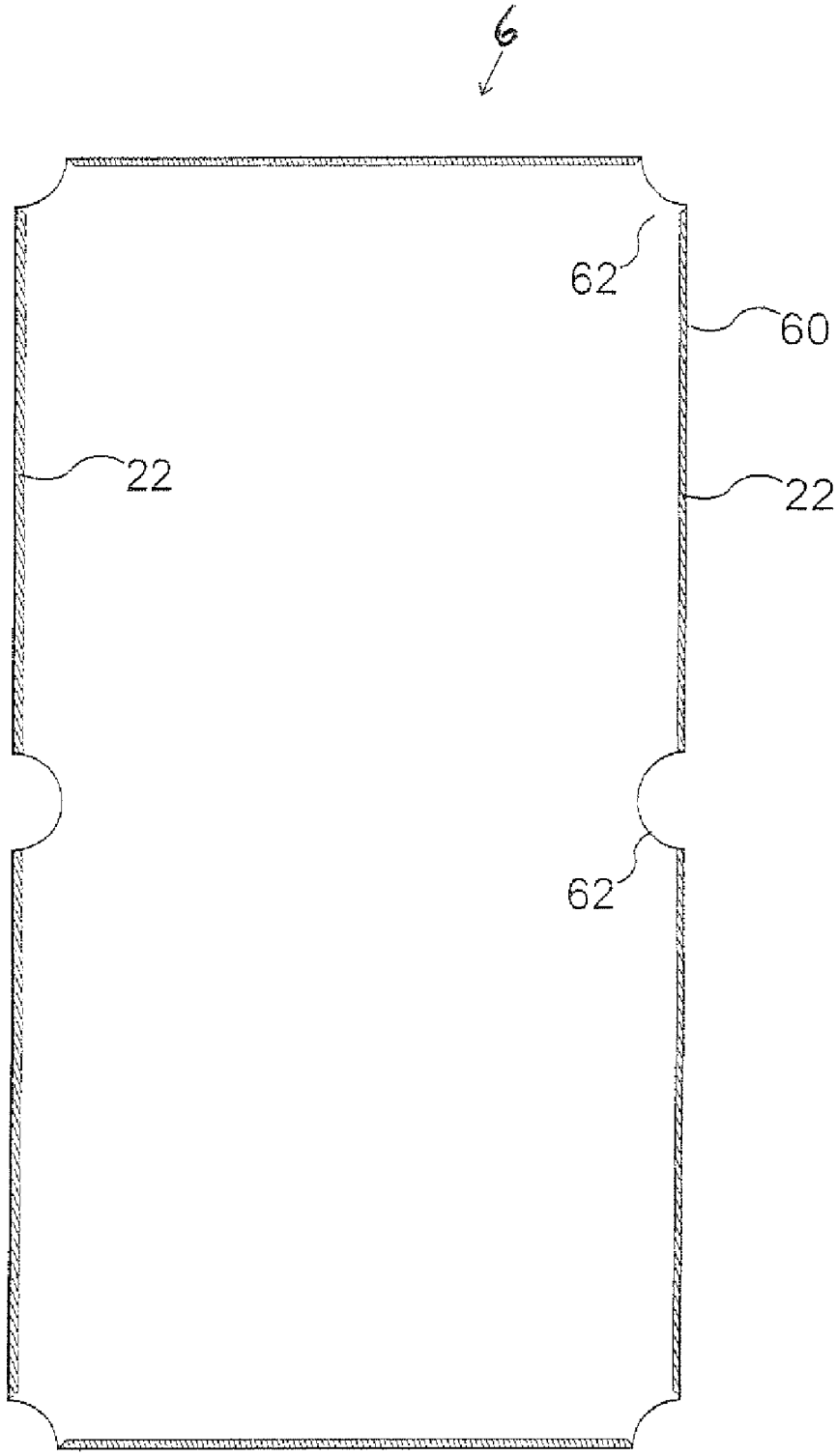
FIG. 5 is a plan view of the bottom of the game table covering cloth with a pre-attached fastening system on perimeter edge.

The table bed cloth of the present invention is shown in plan view from the top in FIG. 4, and in plan view from the bottom in FIG. 5. The invention's preformed pocket openings 62 are shown in FIG. 4. The "A" part 22 is shown in FIG. 5.

Figure 6:
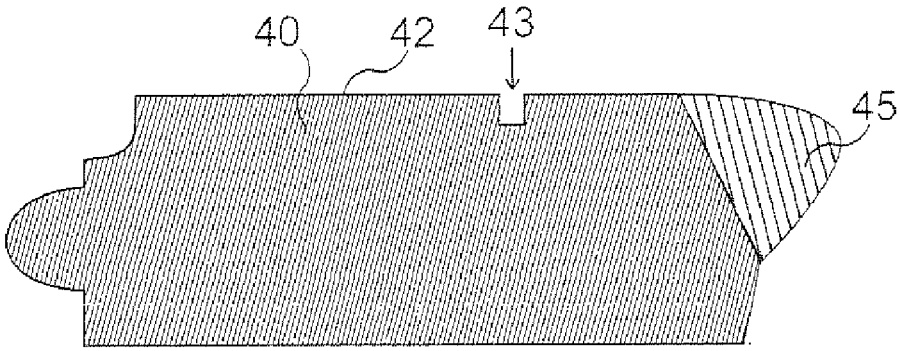
FIG. 6 (PRIOR ART)
FIG. 6 is a cross-sectional view of the rail section and covering of the prior art showing the groove for the conventional feather strip.
Figure 8:
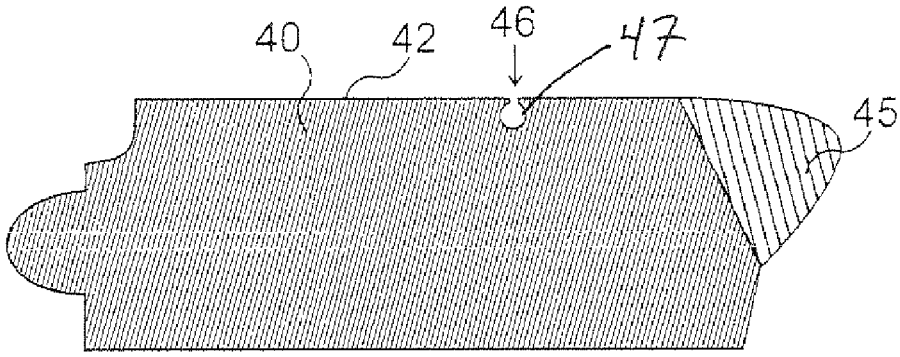
FIG. 8 is a cross-sectional view of the rail and covering of the present invention in a first rail embodiment, showing the tract system opening.
Figure 9:
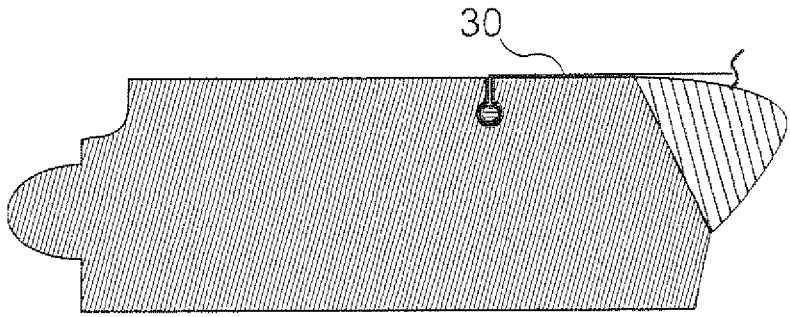
FIG. 9 is a cross-sectional view of the rail and covering of FIG. 8, showing the tract system opening with the rail cloth inserted.
Figure 10:
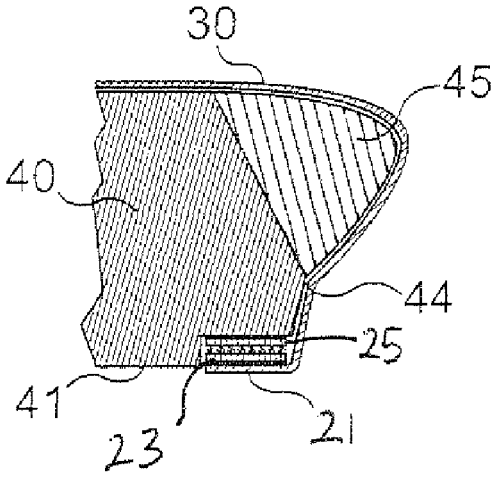
FIG. 10 is a cross-sectional view of the cushion portion of the rail section and covering of FIGS. 9 and 14.
Figure 11:
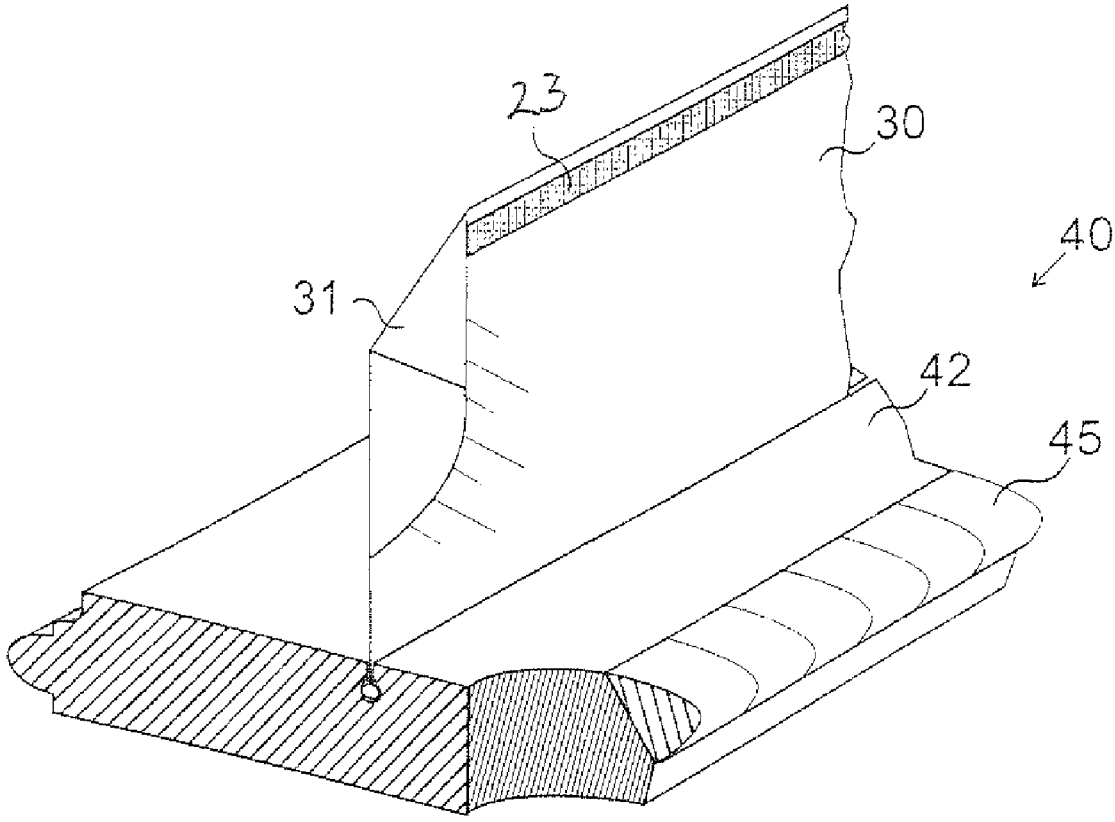
FIG. 11 is an isometric view of the rail and covering of the present invention, showing the ends of the rail cloth preformed and stitched to fit the contour of the rail ends.

FIG. 6 shows a cross-section of a conventional table rail 40, with cushion 45 and a groove 43 on the rail top surface 42, which holds one edge of the rail cloth in place using a feather strip method well-known in the art. As shown isometrically in FIG. 7 and in cross section in FIGS. 8 and 9, the invention replaces the prior-art feather strip method shown in FIG. 6 with a tract system. The rail cloth 30 slides through a tract system groove 46 extending between a tract retaining hole 47 and the rail top surface 42. In a first rail attachment embodiment shown in FIG. 10, the rail cloth 30 attaches to the underside 41 of the rail 40 by means of a hook and loop fastening system 21, such as a Velcro® system, with complementary strips 23 and 25. The ends 31 of the rail cloths 30 are preformed and stitched (sewn) to fit the contour of the rail ends, as shown in FIG. 11.

Figure 7:
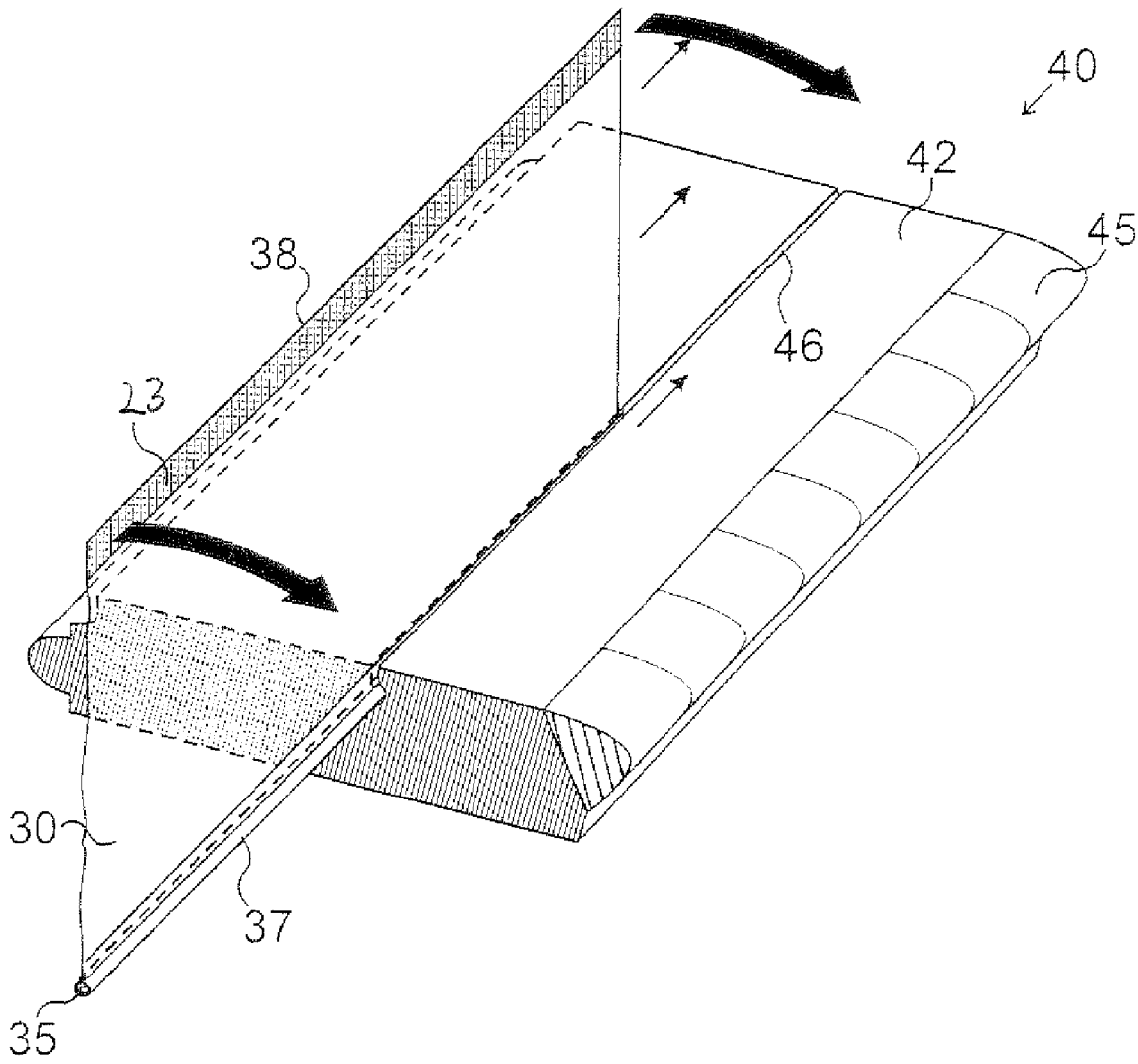
FIG. 7 is an isometric view of the rail section and covering of the present invention, showing the tract system and directions of application of the rail cloth covering.

FIG. 7 shows a portion of the rail cloth 30 during insertion in the tract system groove 46 of the rail section 40. A loop of one edge 37 of rail cloth 30 is sewn around a tract shaft 35 or simply folded and sewn to thicken the edge 37. One strip 23 of the hook and loop fastening system 21 is anchored to the opposite edge 38 of the rail cloth 30. The edge 37 of the rail cloth 30 is then slid into tract groove 46 and the tract retaining hole 47. The tract groove 46 is formed so as to allow only the thickness of rail cloth 30 to pass through the groove's opening to the top surface 42 of rail 40. Once the rail cloth 30 is fully inserted in rail section 40, rail cloth 30 is stretched over cushion 45 and fastened to rail 40 beneath cushion 45.

Figure 12:
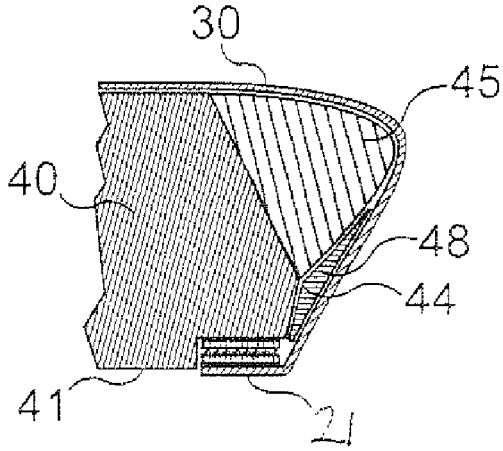
FIG. 12 is a cross-sectional view of the cushion portion of the rail and covering of FIGS. 9 and 14, in a second rail attachment embodiment.
Figure 13:
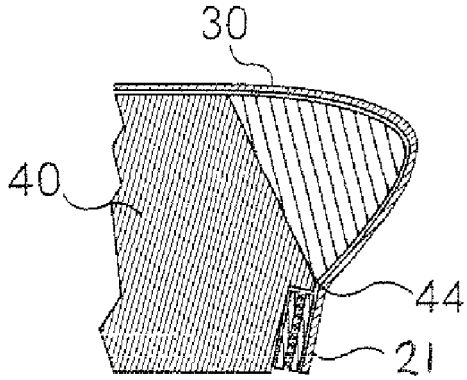
FIG. 13 is a cross-sectional view of the cushion portion of the rail and covering of FIGS. 9 and 14, in a third rail attachment embodiment.

Since the cushion 45 protrudes from the rail 40 to leave a concavity running the length of the rail 40 beneath the cushion 45, the rail cloth 30 is affixed to the rail face 44 beneath the cushion 45 either by the adhesive force of the hook and loop fastening system 20 or by a conventional means such as tacking or stapling once the hook and loop fastening system 20 has been correctly positioned. Alternatively, as shown in FIG. 12, an insert 48 may be placed beneath the cushion 45 so as to support the rail cloth 30 between the cushion 45 and the base of the rail 40. In a second rail attachment embodiment shown in FIG. 13, the rail cloth 30 attaches to the rail face 44 beneath the cushion.

Figure 14:
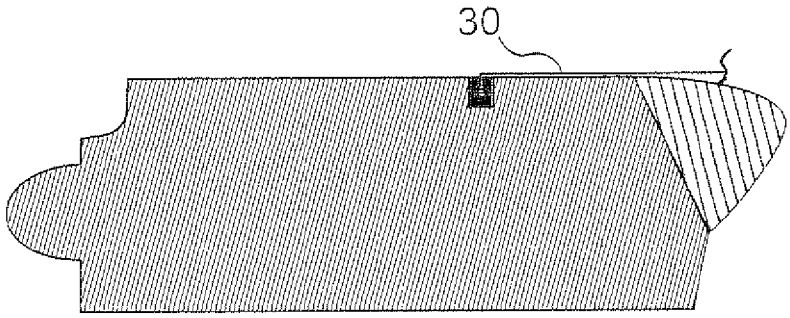
FIG. 14 is a cross-sectional view of the rail and covering of the present invention in a second rail embodiment, showing the tract system opening with the inserted enclosure and the rail cloth inserted in the enclosure.
Figure 15A:
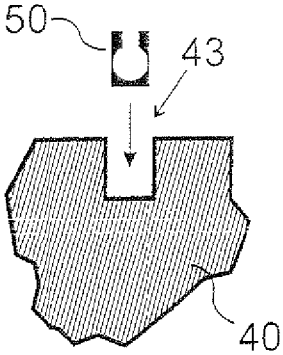
FIG. 15A is a cross-sectional view of the groove portion of a rail and covering of the present invention in the second rail section embodiment, showing the insertion of an enclosure for the tract system into the groove for the conventional feather strip.
Figure 15B:
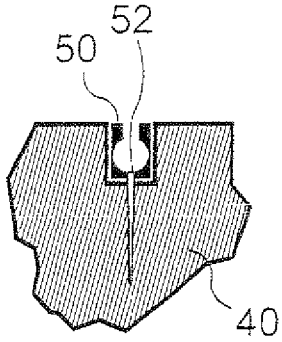
FIG. 15B is a cross-sectional view of the groove portion of a rail and covering of the present invention in the second rail section embodiment, showing the attachment of the enclosure for the tract system within the groove for the conventional feather strip.
Figure 15C:
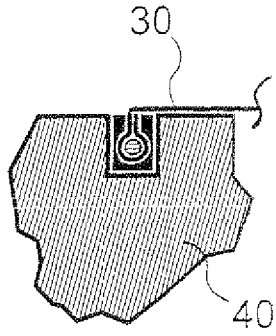
FIG. 15C is a cross-sectional view of the groove portion of a rail and covering of the present invention in the second rail section embodiment, showing the rail cloth inserted in the tract system as in FIG. 14.

An embodiment for upgrading a conventional rail configured for cooperation with a feather strip is shown in FIGS. 14 and 15A. In this embodiment, the invention provides an insertable track 50 to be placed inside the groove 43 for a the feather strip of a conventional rail. The insertable track 50 is installed in the feather strip groove 43 by a press fit, using adhesive, using tacks, using other conventional means, or combinations thereof. The tacks 52 are shown in FIG. 15B. The invention's tract system uses the installed track with the invention's rail cloth 30 as shown in FIG. 15C.

Figure 16:
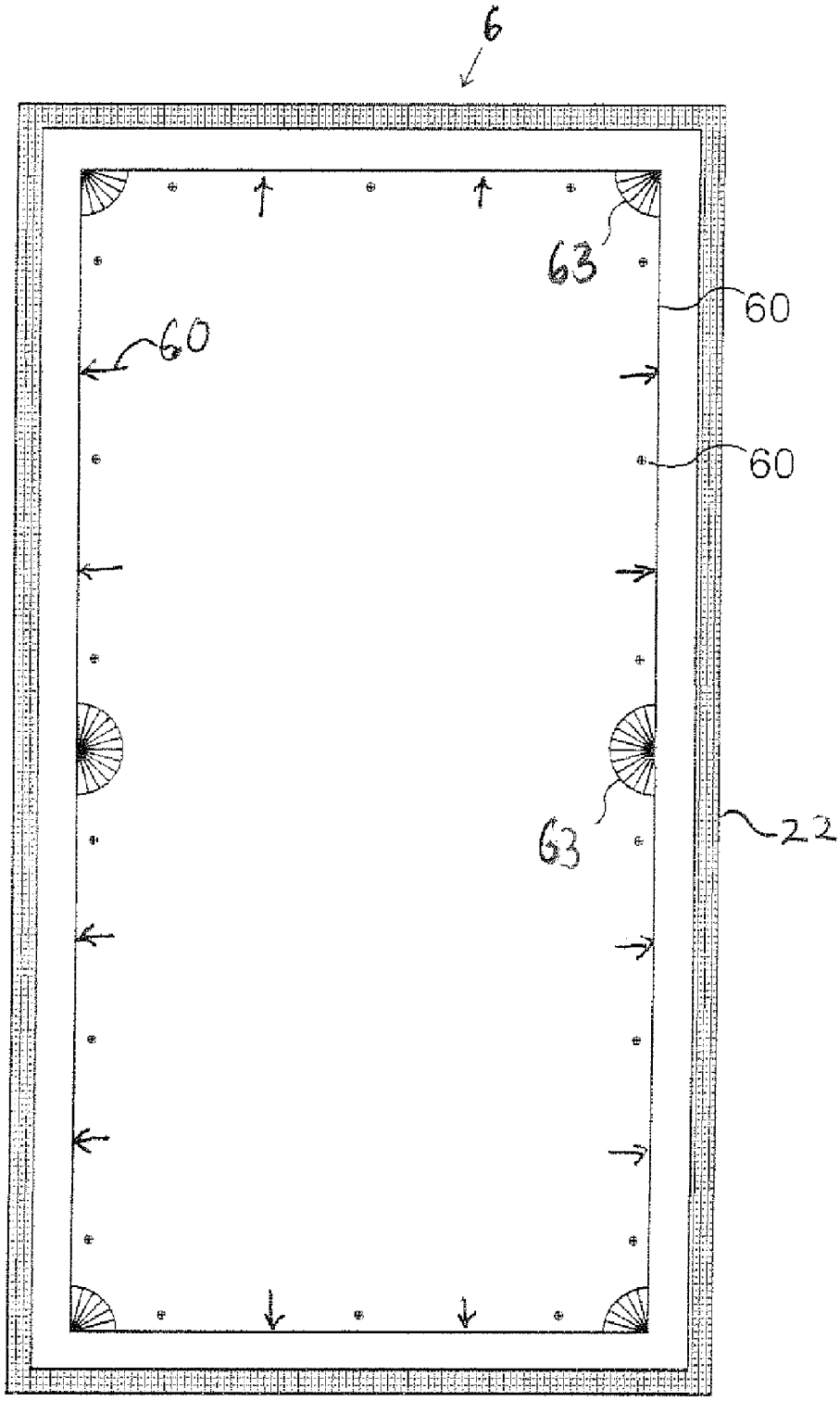
FIG. 16 is a plan view of the game table covering with template markings according to the present invention.

The invention's bed cloth 6 is templated with line markings 60 and/or written instructions on the surface to show the correct position for the cloth on both ends and sides for proper tensioning of the bed cloth when secured (see FIG. 16). The template markings 60 are positioned on the cloth according to the type of cloth and its elasticity, so that when the cloth is drawn to the required tension, template markings 60 are aligned with the table's edges. The template markings 60 may also indicate the location of rail bolt holes.

The installer can now rely on the pre-marked lines to pull or stretch the bed cloth 6 to the right position and tension. The lines 60 on the cloth 6 are pulled to the edges of the table bed and then secured by the hook and loop fastening system 20.

Figure 17A:
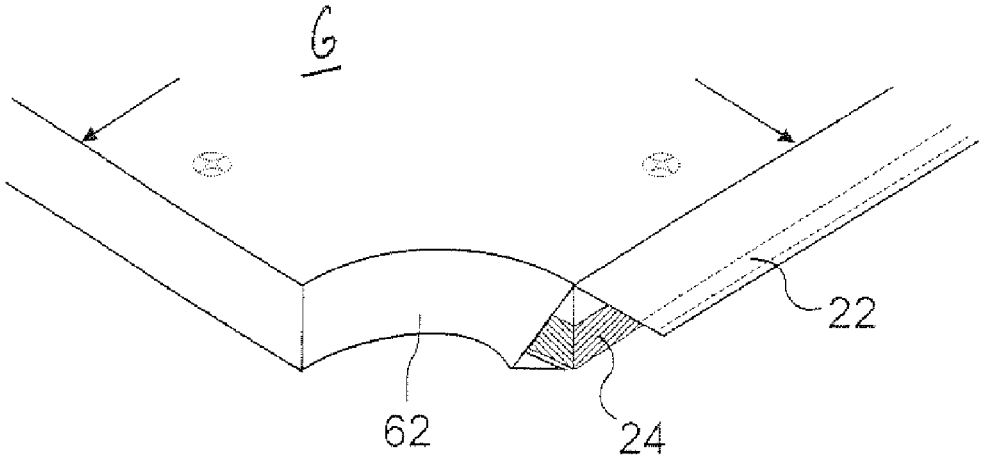
FIG. 17A is a magnified view of a corner of the game table covering cloth of FIG. 4 showing preformed cloth at the pocket opening in the midst of application.
Figure 17B:
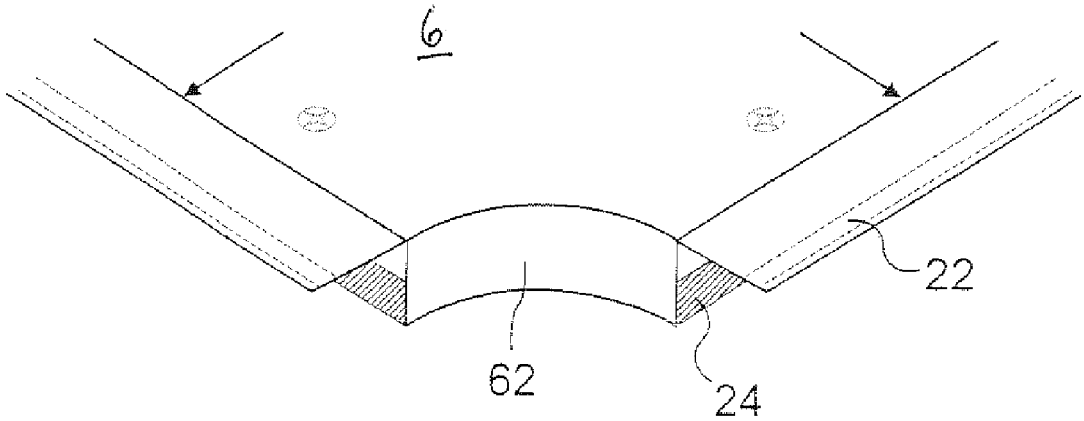
FIG. 17B is a second magnified view of a corner of the game table covering cloth of FIG. 4 showing preformed cloth at the pocket opening after application of the preformed corner cloth is completed.

In a particular pocket-forming embodiment shown in FIGS. 17A and 17B, the invention's bed cloth is produced with preformed openings for pockets that are stitched (sewn) with various patterns to accommodate the pocket openings. The patterns coincide with the type of pocket. A contoured cloth 62 is sewn onto the bed cloth such that the stitch line is below the playing surface when the bed cloth is installed. The hook and loop fastener strip 22 is pre-attached to the bottom of the contoured cloth 62. In some cases, table pockets vary so some cutting of the contoured cloth 62 may be needed for a proper installation.

In an alternative pocket-forming embodiment, tabs 63 are cut in the cloth 6 at the pocket openings using lines templated and pre-marked on the cloth as in FIG. 16 to show the position where the cloth 6 needs to be cut at pocket openings. The cloth 6 may be pre-cut and have the hook and loop fastening system pre-attached to the underside of the cloth at the pockets.

In an alternative securing embodiment, the templating system can be used with the existing staples or glue securing method, or an adhesive system (such as peel and stick method), as opposed to using the hook and loop fastening system.

Process Description

The invention's steps for placing or replacing the cloths of a game table begin with the fabrication of a bed cloth with template markings, pocket cuts, and a bed cloth edge fastening system, and the fabrication of a set of rail cloths, one for each rail section. Both the bed cloth and all rail cloths are marked using templates to show how far each cloth should be stretched to obtain the proper tension in the cloth for use of the table. Each rail cloth is fabricated with a rail cloth edge fastening system along one edge, and a tract edge fastening system along the opposite edge.

To install the cloths, the installer removes all rail sections from the game table to gain access to the bed cloth and the rail cloths for placement. The installer then stretches the bed cloth over the table bed using the bed cloth edge fastening system, and stretches each rail cloth over the rail section's cushion, anchoring the rail cloth's outer edge to the top of the rail using the tract edge fastening system, and anchoring the rail cloth's inner edge under the rail cushion using the rail cloth edge fastening system. The installer completes the job by replacing the rail sections on the game table.

The invention uses a hook and loop edge fastening system in a first fastening embodiment of its bed cloth and rail cloth edge fastening system, anchoring the hook and loop system to the edge of the cloth. In a second fastening embodiment, the invention uses a conventional glue or stapling method of fastening.

To make template markings and pocket cuts in the bed cloth, the invention includes cutting a bed cloth to a size sufficient to anchor said bed cloth to the underside of a game table, stretching the bed cloth over a template of a game table, and marking the bed cloth with the locations of the edges and the pockets of the template. The invention also allows for, whet needed, cutting the bed cloth radially from the centers of the pocket locations of the table template to the edges of the pocket locations of the table template, allowing the cloth to hang down into the pockets to provide attachment for the pockets themselves.

To make template markings in a rail cloth, the invention includes cutting a rail cloth to a size sufficient to anchor the rail cloth to the top of a rail section and the underside of the rail section, stretching the rail cloth over a template of a game table rail, anchoring the rail cloth to the template, and marking the rail cloth with the location of the edge of the template.

To constrict a tract edge fastening system, the invention includes cutting a retaining groove in each rail section substantially parallel to the rail cushion, cutting a rail cloth to a size sufficient to anchor the rail cloth to the rail section, fabricating a closed loop along the first edge of the rail cloth substantially parallel to the rail section to contain a tract shaft, and inserting the tract shaft in the closed loop. Making the retaining groove includes drilling a tract retaining hole in each rail section substantially parallel to the rail cushion and the full length of the rail section and cutting a tract retaining groove from the rail top through to the tract retaining hole. To hold the edge of the rail cloth, the tract retaining groove has a width smaller than the diameter of the tract shaft.

In an alternative tract edge fastening system embodiment better suited to conversion of conventional rail sections for the invention's use, the invention provides a tract retainer, of a size sufficient to contain and hold the tract shaft and the closed loop of the rail cloth, to be installed in the feather strip groove of each conventional rail section substantially parallel to the rail cushion. The installer anchors the tract retainer in the rail feather strip groove.

The bed cloth is fastened to the table using the invention's hook and loop fastening strip anchored to the table's horizontal underside or anchored to the outer vertical face of the table's underside. The rail cloth is fastened to the rail by anchoring a rail cloth hook and loop fastening strip to the edge of the rail cloth opposite the edge carrying the tract system, and fastening the fastening strip to its counterpart fastening strip on either the underside of the rail section or the inner face of the rail section below the cushion. In a particular embodiment, the hook and loop fastening strips are pre-attached to the edge of the cloth and the underside of the table.

The invention's methods for the installation of cloth coverings for game tables greatly simplifies the installation process. The simplification allows for more installations within a given time period, thereby raising installer productivity. The simplification also enables installation by less-skilled individuals, thereby reducing installation labor cost. Finally, and most importantly, the simplification provides a level of accuracy not yet attained in a consistent repetitive manner with the use of conventional methods.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. An apparatus for installing cloth on rails of a billiard or pool game table having a table bed, a rectangular periphery and a plurality of pockets in the periphery of the table bed and a plurality of rails surrounding the table bed, each rail extending from one pocket to another pocket and each rail having a rail cushion facing toward the bed and having contoured surfaces proximate the pockets and facing away from the pockets, comprising:

a rail cloth for covering the rail cushion;

a plurality of contours in the ends of the rail cloth to fit the contoured surfaces on the ends of the rails without overlapping the rail cloth;

a first rail cloth fastening system engaging a first edge of the rail cloth for attaching the rail cloth to the top of the rail; and a pre-attached rail cloth fastening system for fastening the rail cloth over the rail cushion and for varying the tension in the rail cloth, wherein the first rail cloth fastening system comprises:

a tract groove in the rail, said groove having an opening in the surface of the groove, said opening having a width that is large enough to accommodate the thickness of the rail cloth while retaining an edge of the rail cloth within the tract groove.

2. The apparatus of claim 1, further comprising a tract shaft, the tract shaft engaging a first edge of the rail cloth disposed inside the tract bore.

3. The apparatus of claim 1, wherein the end of the rail cloth in the tract bore overlaps the proximate cloth to provide a rail cloth end with at least more than one layer of thickness inside the tract bore.

4. An apparatus for installing cloth on rails of a billiard or pool game table having a table bed, a rectangular periphery and a plurality of pockets in the periphery of the table bed and a plurality of rails surrounding the table bed, each rail extending from one pocket to another pocket and each rail having a rail cushion facing toward the bed and having contoured surfaces proximate the pockets and facing away from the pockets, comprising:

a rail cloth for covering the rail cushion;

a plurality of contours in the ends of the rail cloth to fit the contoured surfaces on the ends of the rails;

a first rail cloth fastening system engaging a first edge of the rail cloth for attaching the rail cloth to the top of the rail; and a pre-attached rail cloth fastening system for fastening the rail cloth over the rail cushion and for varying the tension in the rail cloth;

wherein the game table rails have a feather strip groove and the first rail cloth fastening system comprises:

a tract retainer disposed in the feather strip groove; and a tract groove in the tract retainer, said groove having an opening in the surface of the groove, said opening having a width that is large enough to accommodate the thickness of the rail cloth while retaining an edge of the rail cloth within the tract groove.

5. The apparatus of claim 4, further comprising a tract shaft, the tract shaft engaging a first edge of the rail cloth.

6. The apparatus of claim 4, further comprising a means for anchoring the tract retainer in the feather strip groove.

* * * * *